US008065760B2

(12) United States Patent
Brune

(10) Patent No.: US 8,065,760 B2
(45) Date of Patent: Nov. 29, 2011

(54) FOLDABLE COT

(75) Inventor: Adam N. Brune, New Haven, MO (US)

(73) Assignee: Active Lifestyle & Products & Services, Inc., New Haven, MO (US)

( * ) Notice: Subject to any disclaimer, the term of this patent is extended or adjusted under 35 U.S.C. 154(b) by 0 days.

(21) Appl. No.: 12/465,768

(22) Filed: May 14, 2009

(65) Prior Publication Data

US 2010/0287699 A1 Nov. 18, 2010

(51) Int. Cl.
*A47C 19/04* (2006.01)

(52) U.S. Cl. ..... 5/111; 5/110; 5/112; 5/114

(58) Field of Classification Search ..... 5/110–112, 5/114

See application file for complete search history.

(56) References Cited

U.S. PATENT DOCUMENTS

| | | | | |
|---|---|---|---|---|
| 3,601,825 | A * | 8/1971 | Moorhead et al. | 5/110 |
| 5,109,556 | A | 5/1992 | Cook | |
| 6,618,879 | B1 * | 9/2003 | Wu | 5/111 |
| 6,705,234 | B1 * | 3/2004 | Miller et al. | 108/36 |
| 7,103,927 | B2 * | 9/2006 | Holub | 5/111 |
| 7,661,159 | B1 * | 2/2010 | Chen | 5/116 |
| 7,770,246 | B2 * | 8/2010 | Chen | 5/111 |

FOREIGN PATENT DOCUMENTS

CN ZL200720006729.5 4/2008

* cited by examiner

*Primary Examiner* — Robert G Santos
*Assistant Examiner* — Brittany M Wilson
(74) *Attorney, Agent, or Firm* — Clayton, Howarth & Cannon, P.C.

(57) ABSTRACT

This invention presents a foldable cot. The foldable cot includes a foldable frame and a flexible sheet having a generally rectangular shape. The peripheral portions of the flexible sheet are secured to the foldable frame. The foldable frame has two-pairs of hingedly connected longitudinal bars, which allows the foldable frame to be folded in a longitudinal direction. A middle support structure is mounted to the hinge connectors. The middle support structure includes a pair of crossbars having a general X-shape. Upper ends of the crossbars are pivotably connected to the hinge connectors. There is provided a pair of vertical poles connecting the upper ends and lower ends of the crossbars, respectively. The vertical poles are extendible between a retracted position and an extended position, which allows the X-shaped crossbars to have a scissors-like motion so that the foldable frame can be folded in a transverse direction.

16 Claims, 11 Drawing Sheets

FOLDABLE COT

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

The present invention relates generally to cots, and more particularly to a foldable cot.

2. Description of Related Art

Portable beds or cots have been used for many years. Such cots are widely used in conjunction with out door activities such as mountain climbing, fishing, boating, hunting, camping, flying, and the like. Foldable cots of existing types are not as satisfactory as could be desired. Such cots can also be used as an extra bed for home use.

A typical foldable cot includes a body-supporting sheet and a frame. Some of existing cots can be folded by dissembling the frame. Others utilize foldable frames. However, foldable cots of existing types are not as satisfactory as could be desired.

SUMMARY OF THE INVENTION

One aspect of the present invention is a foldable cot that includes a foldable frame having a folded position and an unfolded position and a flexible sheet secured to the foldable frame. The foldable frame includes a first longitudinal bar and a second longitudinal bar hingedly connected with each other via a first middle hinge connector the foldable frame also has a third longitudinal bar and a fourth longitudinal bar hingedly connected with each other via a second middle hinge connector. The foldable frame includes a middle support structure mounted to the first and second middle hinge connectors. The middle support structure has a first crossbar and a second crossbar together forming a general X-shape when in the unfolded position. The upper ends of the crossbars are pivotably connected to the middle hinge connectors. The middle support structure further has a first vertical pole and a second vertical pole each having a top end attached to the middle hinge connectors. The lower ends of the crossbars are pivotably connected to a bottom end of the vertical poles. The vertical poles are extendible between a retracted position and an extended position.

In a preferred embodiment, the crossbars are connected in the middle to each other such that the crossbars are rotatable relative to each other.

In a preferred embodiment, each of the vertical poles has a first pole member and a second pole member. The first pole member of the first and second vertical poles is attached to the first and second middle hinge connectors, respectively. The second pole member is slidable along the first pole member. Preferably, the first pole member is a hollowed member, and the second pole member is an inner rod slideably disposed within the hollowed member. In this preferred embodiment, the first and second vertical poles are in the extended position when the inner rods are extended out of the hollowed members. The first and second vertical poles are in the retracted position when the inner rods are retracted into the hollowed member. In a preferred embodiment, the hollowed members and inner rods have angled cross-section such that the inner rods are not allowed to rotate within the hollowed members relative to the hollowed members.

In a preferred embodiment, the first and second crossbars are pivotably connected to the first and second middle hinge connectors and to the bottom end of the first and second vertical poles via L-shaped crossbar hinge brackets.

In a preferred embodiment, the foldable frame also has a first transverse bar removably connected between the first and third longitudinal bars and a second transverse bar removably connected between the second and fourth longitudinal bars. In this preferred embodiment, the first and second transverse bars are identical and each of the longitudinal bars has a mount for removably attaching the first and second transverse bars thereto.

In a preferred embodiment, the foldable frame further has a first leg pivotably attached to the first longitudinal bar, a second leg pivotably attached to the second longitudinal bar, a third leg pivotably attached to the third longitudinal bar, and a fourth leg pivotably attached to the fourth longitudinal bar. Preferably, the legs are pivotably connected to the respective longitudinal bars via leg hinge brackets. The leg hinge brackets allow the legs to pivot between a folded position and an untolded position. The unfolded position and folded position define therebetween an angle substantially larger than 90° but substantially less than 180°. In a preferred embodiment, the first second, third, and fourth legs are pivotable independently of one another. In a preferred embodiment, the foldable frame further has a first leg connecting bar removably connected between the first and third legs and a second leg connecting bar removably connected between the second and fourth legs: Preferably, the first and second leg connecting bars are identical. Each of the first, second, third, and fourth legs has a mount for removably attaching the first and second leg connecting bars thereto.

In a preferred embodiment, the flexible sheet has a plurality of longitudinal sleeves in its peripheral portions for receiving the first, second, third, and fourth longitudinal bars therein. In the embodiment where the foldable frame has transverse bars, the flexible sheet has a plurality of transverse sleeves in the peripheral portions for removably receiving the first and second transverse bars therein.

Another aspect of the present invention is a foldable cot frame having a folded position and an unfolded position. The foldable cot frame includes a first longitudinal bar and a second longitudinal bar hingedly connected with each other via a first middle hinge connector. The foldable cot frame also includes a third longitudinal bar and a fourth longitudinal bar hingedly connected with each other via a second middle hinge connector. A middle support structure is mounted to the first and second middle hinge connectors. The middle support structure has a first crossbar and a second crossbar together forming a general X-shape when the foldable frame is in the unfolded position. Upper ends of the crossbars are pivotably connected to the middle hinge connectors. The middle support structure also has a first vertical pole and a second vertical pole each having a top end attached to the first and second middle hinge connectors, respectively. Lower ends of the first and second crossbars are pivotably connected to a bottom end of The first and second vertical poles, respectively. The first and second vertical poles are extendible between a retracted position and an extended position.

In a preferred embodiment, each of the first and second vertical poles comprises a first pole member and a second pole member. The first pole member of the first and second vertical poles is attached to the first and second middle hinge connectors, respectively. The second pole member is slidable along the first pole member. Preferably, the first pole member is a hollowed member, and the second pole member is an inner rod slideably disposed within the hollowed member. The first and second vertical poles are in the extended position when the inner rods are extended out of the hollowed members. The first and second vertical poles are in the retracted position when the inner rods are retracted into the hollowed member.

In a preferred embodiment, a first transverse bar is removably connected between the first and third longitudinal bars and a second transverse bar is removably connected between the second and fourth longitudinal bars.

In a preferred embodiment, a first leg is pivotably attached to the first longitudinal bar, a second leg is pivotably attached to the second longitudinal bar., a third leg is pivotably attached to the third longitudinal bar, and a fourth leg is pivotably attached to the fourth longitudinal bar.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE INVENTION

Figure 1:
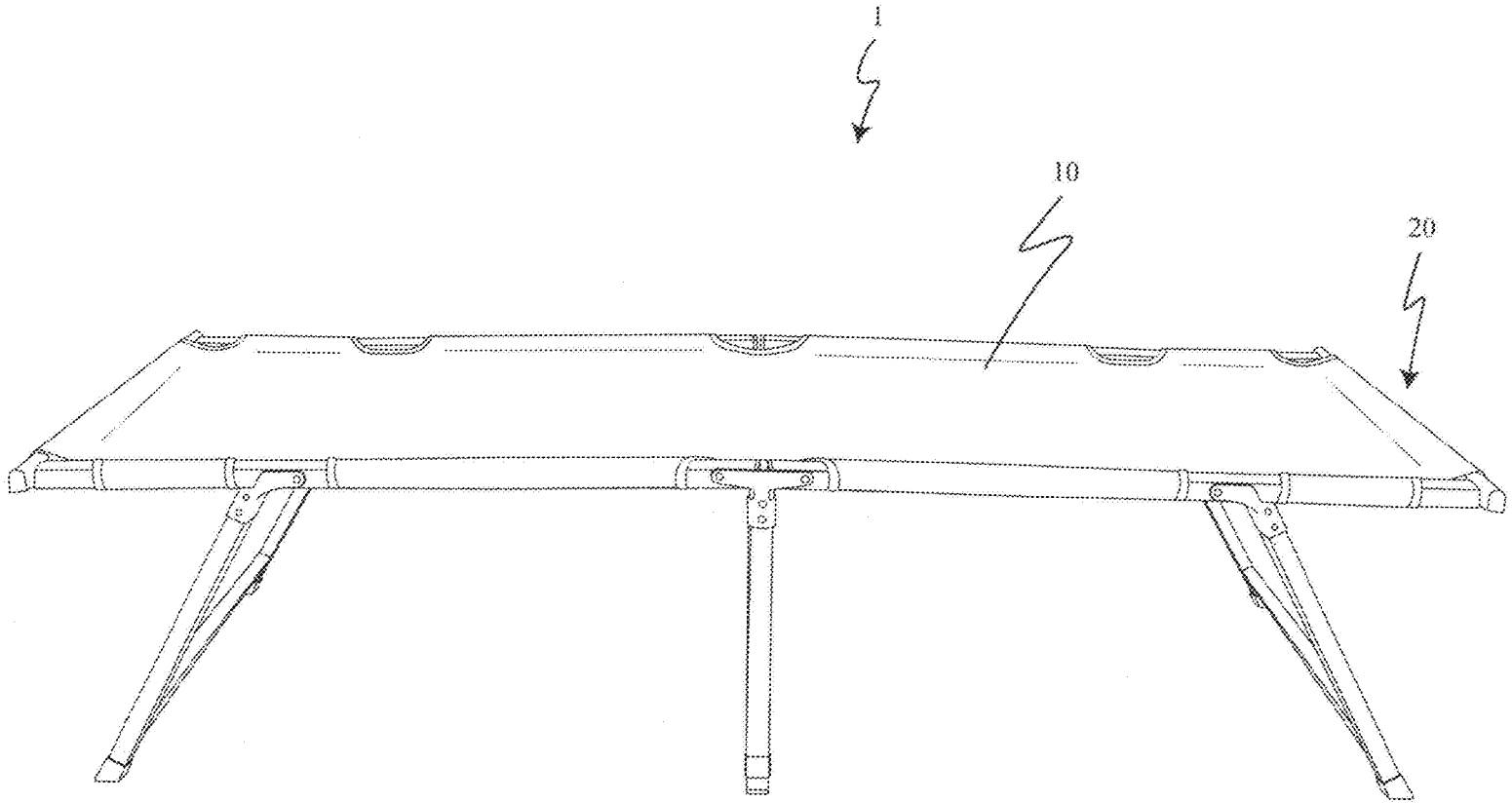
FIG. 1 is a top front perspective view of a foldable cot according to an embodiment of the present invention.
Figure 2:
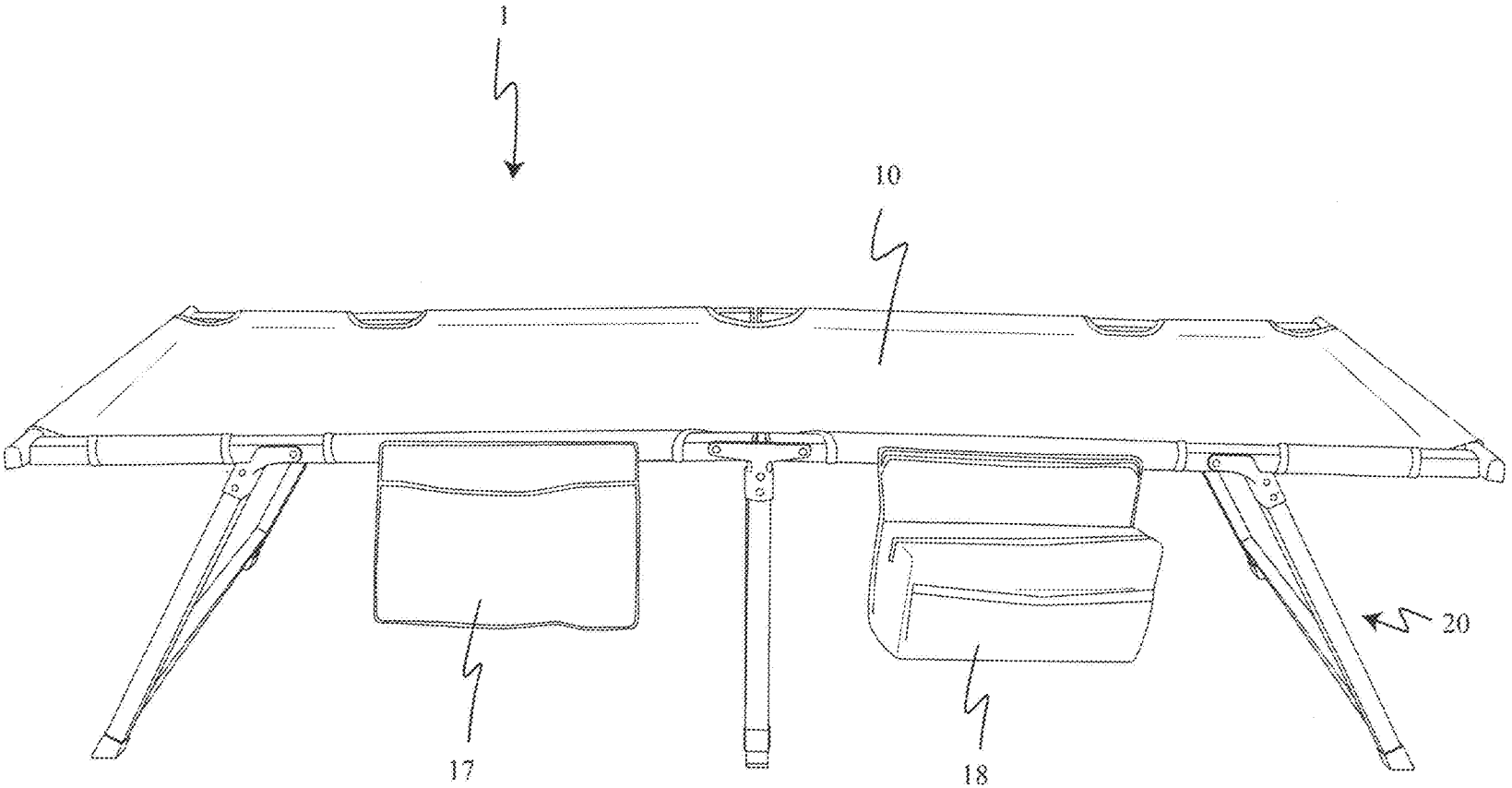
FIG. 2 is a rear perspective view of the foldable cot of FIG. 1.
Figure 3:
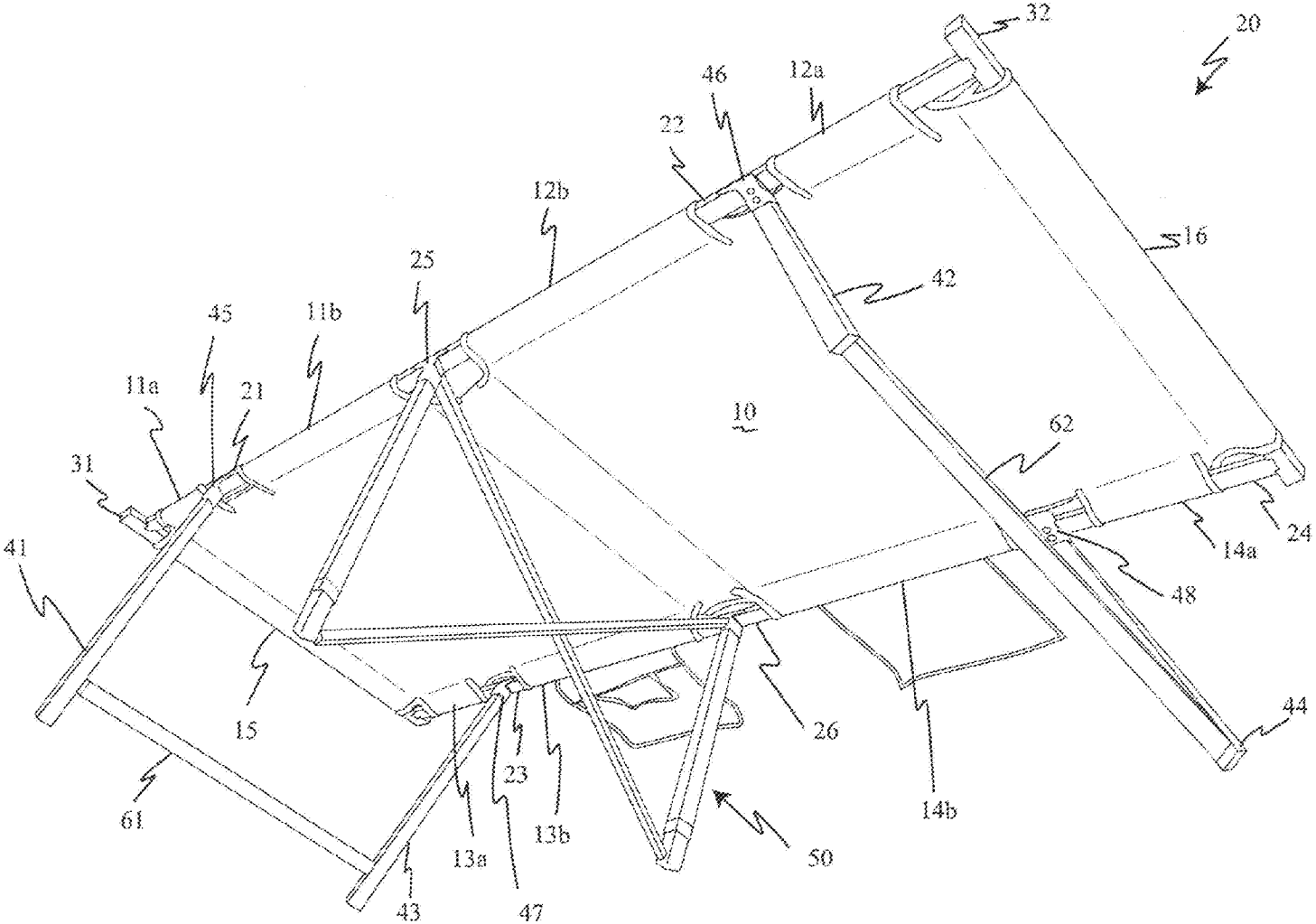
FIG. 3 is a bottom front perspective view of the foldable cot of FIG. 1.

Shown in FIGS. 1 and 2 is a foldable cot 1 according to an embodiment of the present invention. The foldable cot 1 comprises a flexible sheet 10 and a foldable frame 20. The flexible sheet 10 furnishes support for a user (not shown) lying thereon. In FIG. 2, the foldable cot 1 includes optional pockets 17, 18 attached to peripheral portions of the flexible sheet 10. The foldable frame 20 can be folded from an unfolded position for use to a folded position for storage or carrying as further explained below. In FIGS. 1, 2 and 3, the foldable frame 20 is shown in its fully unfolded position.

As shown in FIG. 3, the foldable frame 20 has a first longitudinal bar 21, a second longitudinal bar 22, a third longitudinal bar 23, and a fourth longitudinal bar 24. The first and second longitudinal bars 21, 22 are hingedly connected to each other via a first middle hinge connector 25. The third and fourth longitudinal bars 23. 24 are hingedly connected to each other via a second middle hinge connector 26. This configuration allows the foldable frame 20 to be folded in its longitudinal direction.

Figure 4:
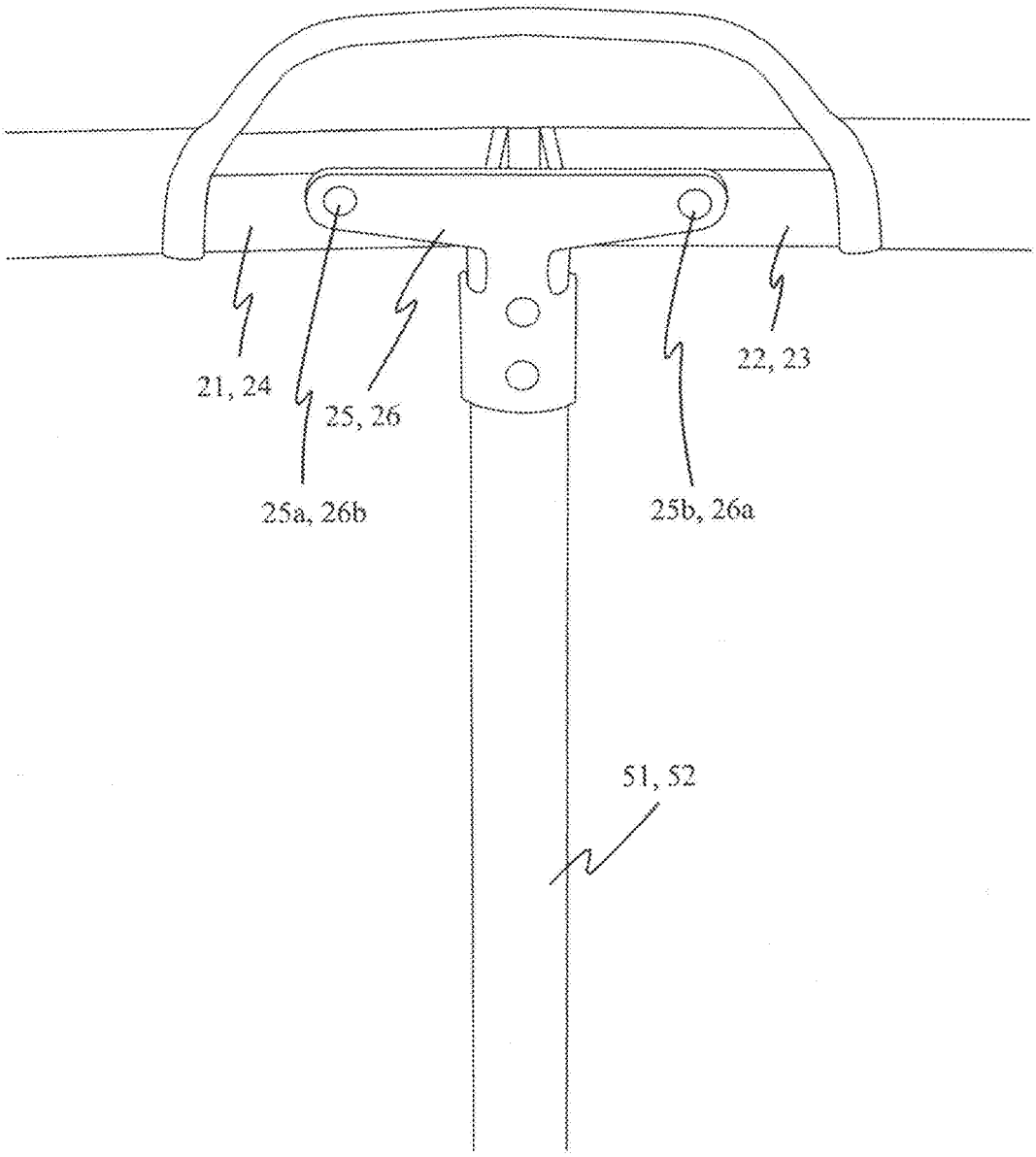
FIG. 4 is an enlarged, partial view of the foldable cot of FIG. 1.

In the illustrated embodiment as best seen in FIG. 4, the first and second middle hinge connectors 25, 26 are T-shaped. The first and second middle hinge connectors 25, 26 are attached to a first vertical pole 51, and a second vertical pole 52. The first and second vertical poles 51, 52 are further explained below. The first longitudinal bar 21 is pivotably connected to the first middle hinge connector 25 such that the first longitudinal bar 21 can rotate around a first pivot axis 25*a* of the first middle hinge connector 25. The second longitudinal bar 22 is pivotably connected to the first middle hinge connector 25 such that the second longitudinal bar 22 can rotate around a second pivot axis 25*b* of the first middle hinge connector 25. Likewise, the third longitudinal bar 23 is pivotably connected to the second middle hinge connector 26 such that the third longitudinal bar 23 can rotate around a first pivot axis 26*a* of the second middle hinge connector 26. The fourth longitudinal bar 24 is pivotably connected to the second middle hinge connector 26 such that the fourth longitudinal bar 24 can rotate around a second pivot axis 26*b* of the second middle hinge connector 26.

Figure 11:
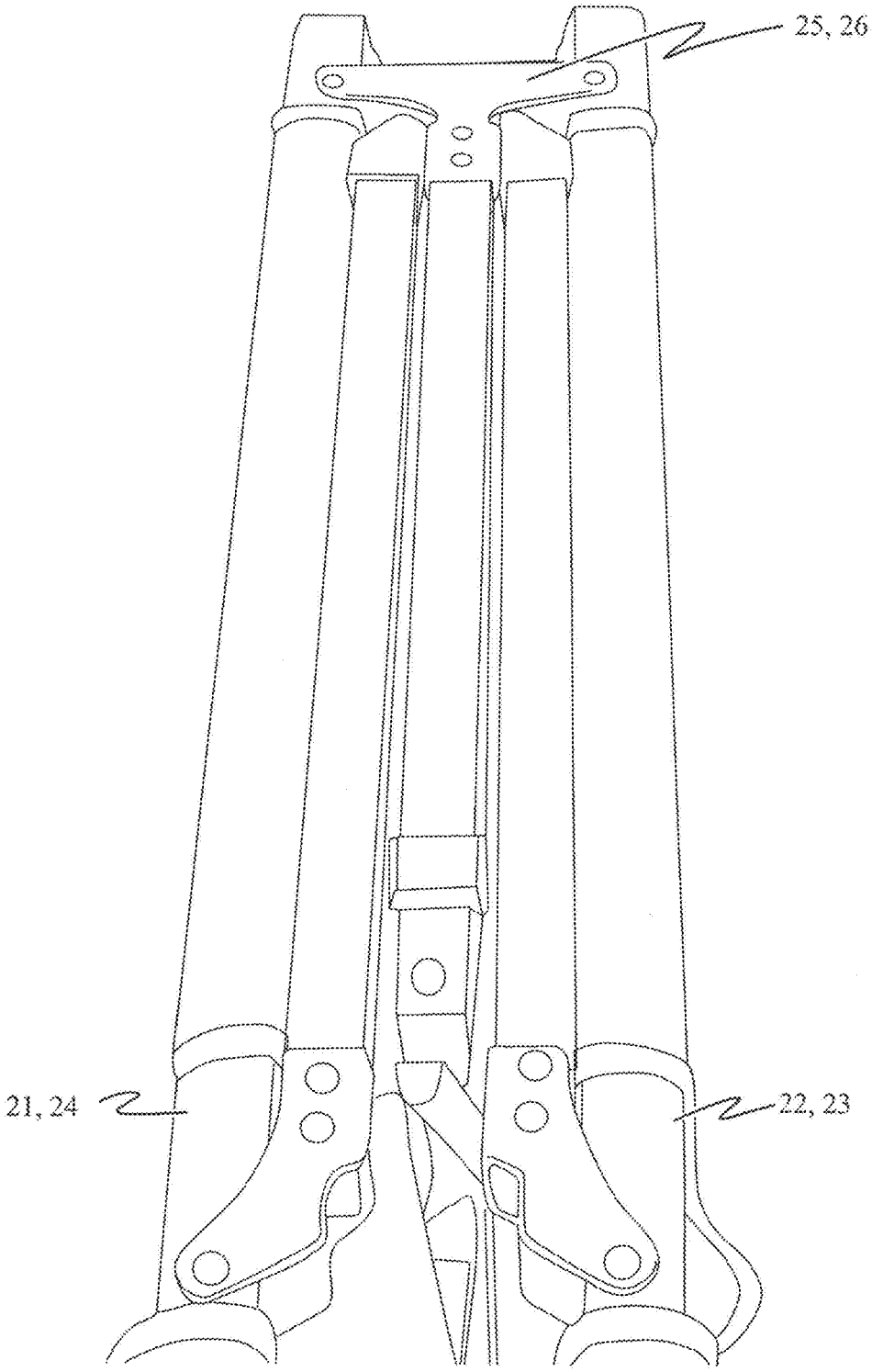
FIG. 11 is a partial, bottom perspective view of the folding cot of FIG. 1 where the longitudinal bars are in the folded position.

This configuration allows the longitudinal bars 21, 22, 23, 24 to pivot between a folded position and an unfolded position. While FIG. 4 shows the longitudinal bars 21, 22, 23, 24 in the unfolded position, FIG. 11 shows the longitudinal bars 21, 22, 23. 24 in the folded position. In the folded position as in FIG. 11, the longitudinal bars 21, 22, 23, 24 are parallel with the vertical poles 51, 52. In the unfolded position as in FIG. 4, the longitudinal bars 21, 22, 23, 24 are perpendicular to the vertical poles 51. 52. This configuration allows the foldable frame 20 to be folded in its longitudinal direction.

The first middle hinge connector 25 is designed to allow the first and second longitudinal bars 21, 22 to rotate around the pivot axis 25*a*, 25*b*, respectively, only to a restricted extent so that the longitudinal bars cannot pivot beyond the unfolded position where the first and second longitudinal bars 21, 22 are perpendicular to the vertical pole 51. Likewise, the second middle hinge connector 26 is designed to allow the third and fourth longitudinal bars 23, 24 to rotate around the pivot axis 26*a*, 26*b*, respectively, only to a restricted extent so that the longitudinal bars cannot pivot beyond the unfolded position where the third and fourth longitudinal bars 23, 24 are perpendicular to the vertical pole 52. Preferably, the first and second middle hinge connectors 25, 26 are identical.

The foldable frame 20 also has a first transverse bar 31 and a second transverse bar 32. The first transverse bar 31 is removably connected between the first and third longitudinal bars 21, 23. The second transverse bar 32 is removably connected between the second and fourth longitudinal bars 22, 24. When connected as shown in FIG. 3, the transverse bars 31, 32 together with the longitudinal bars 21, 22, 23, 24 maintain tension on the flexible sheet 10. The transverse bars 31, 32 are removed before the foldable frame 20 can be folded in its transverse direction as further explained below. Preferably, the First and second transverse bars 31, 32 are identical.

Figure 7:
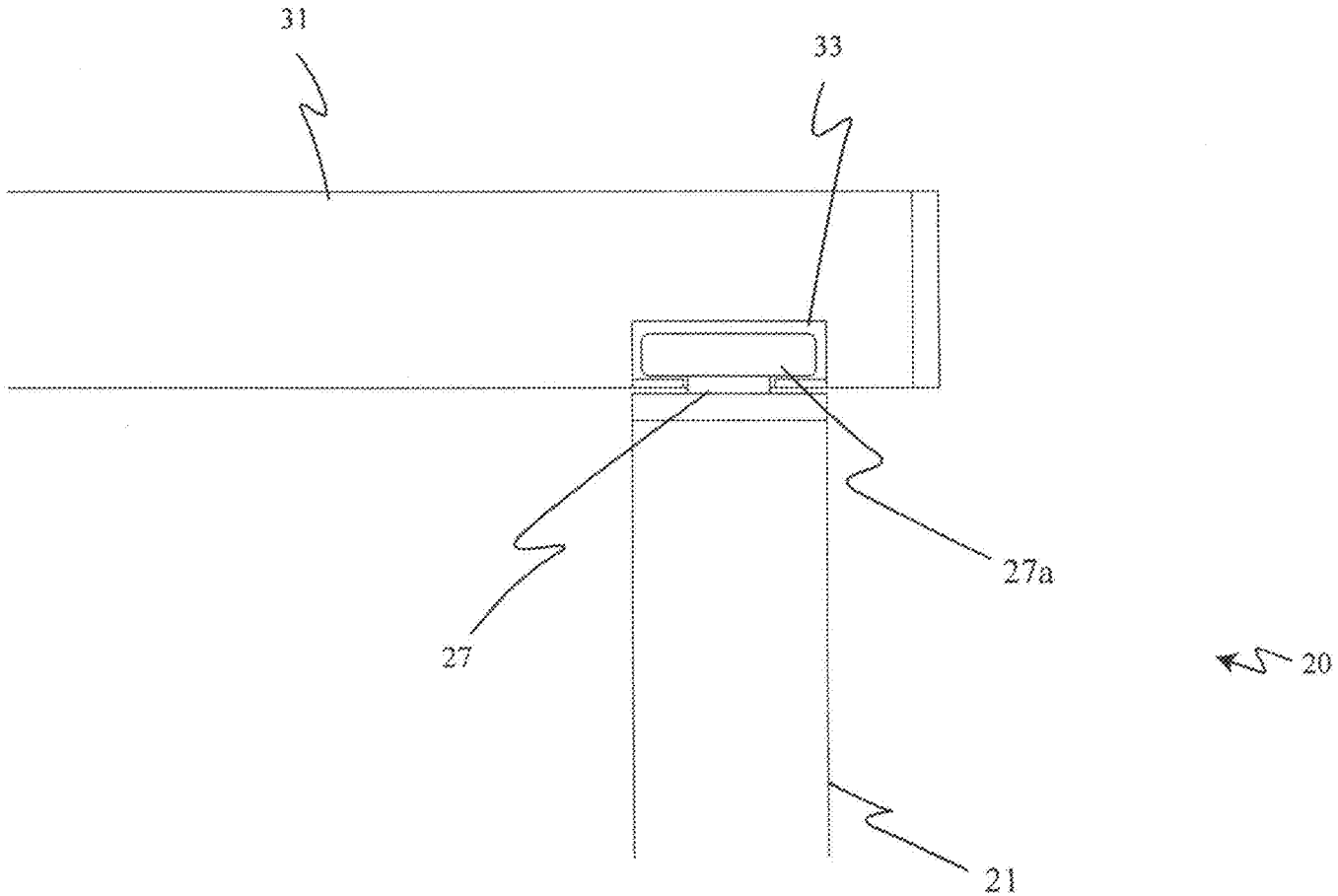
FIG. 7 is an enlarged, partial view of the foldable cot of FIG. 3.

As best seen in FIG. 7, the first longitudinal bar 21 has a mount extrusion 27 attached to its outer end. Likewise, each of the second, third, and fourth longitudinal bars 22, 23, 24 also has an extrusion 27 attached to its outer end. Each of the mount extrusions 27 has an enlarged head portion 27*a*. The first transverse bar 31 has a pair of identical mount cavities 33 at its end portions for removably receiving the enlarged head portion 27*a* of the first and third longitudinal bars 21, 23, respectively. Likewise, the second transverse bar 32 also has a pair of identical mount cavities 33 at its end portions for removably receiving the enlarged head portion 27*a* of the second and fourth longitudinal bars 22, 24, respectively.

The flexible sheet 10 has longitudinal sleeves 11*a*, 11*b*, 12*a*, 12*b*, 13*a*, 13*b*, 14*a*, 14*b* in its peripheral portions for receiving the longitudinal bars 21, 22, 23, 24, respectively. The flexible sheet 10 also has transverse sleeves 15, 16 along its periphery for removably receiving the transverse bars 31, 32, respectively. Accordingly, when connected with the longitudinal bars 21, 22, 23, 24, the transverse bars 31, 32 together with the longitudinal bars 21, 22, 23, 24 can maintain tension on the flexible sheet 10. The transverse bars 31, 32 can be disconnected from the respective longitudinal bars 21. 23; 22, 24 and then removed from the respective transverse sleeves 15, 16.

The foldable frame 20 also has a first leg 41, a second leg 42, a third leg 43, and a fourth leg 44. The first leg 41 is pivotably connected to the first longitudinal bar 21 via a first leg hinge bracket 45. The second leg 42 is pivotably connected to the second longitudinal bar 22 via a second leg hinge bracket 46. The third leg 43 is pivotably connected to the third longitudinal bar 23 via a third leg hinge bracket 47. The fourth leg 44 is pivotably connected to the fourth longitudinal bar 24 via a fourth leg hinge bracket 48.

Figure 5:
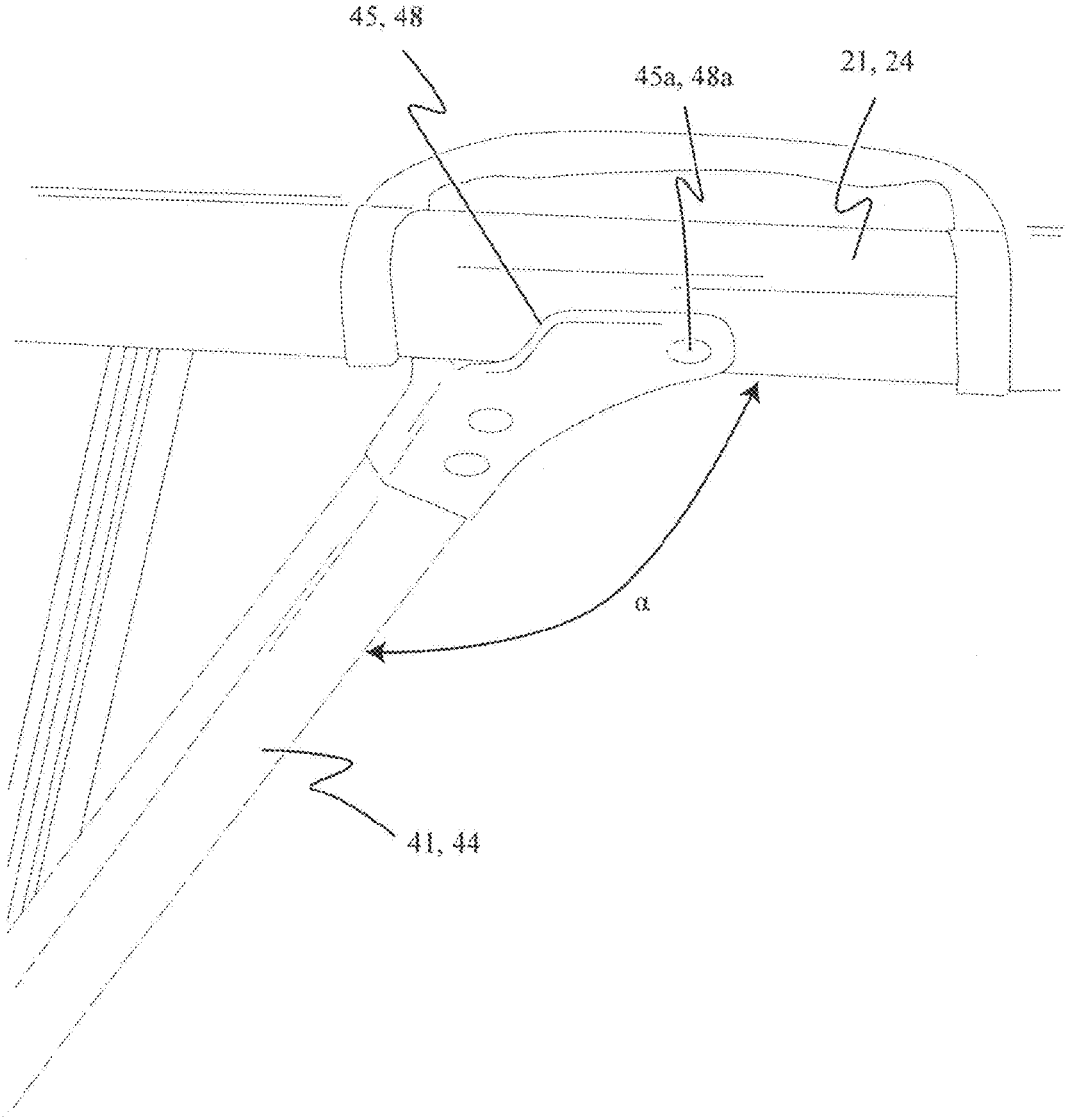
FIG. 5 is an enlarged, partial view of the foldable cot of FIG. 1.
Figure 6:
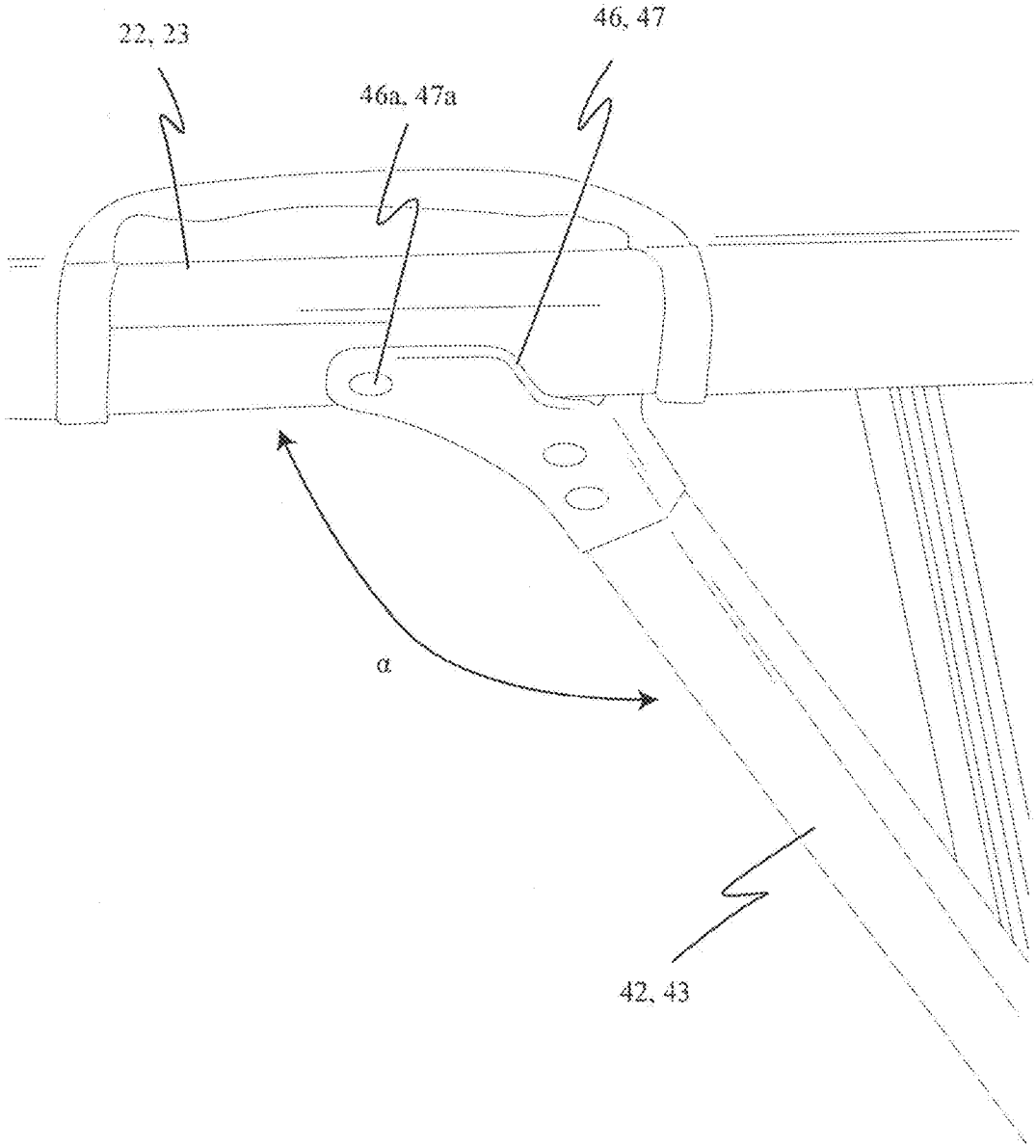
FIG. 6 is an enlarged, partial view of the foldable cot of FIG. 1.

As best seen in FIGS. 5 and 6, the leg hinge brackets 45, 46, 47, 48 are fixedly attached to their respective legs 41, 42, 43, 44, and pivotably attached to their respective longitudinal bars 21, 22, 23, 24. The legs 41, 42, 43, 44 together with their respective leg hinge brackets 45, 46, 47, 48 are pivotable around their respective pivot axes 45*a*, 46*a*, 47*a*, 48*a* between a folded position and an unfolded position relative to the respective longitudinal bars 21, 22, 23, 24. In FIGS. 5 and 6, the legs 41, 42, 43, 44 are shown in the unfolded position.

The leg hinge brackets 45, 46, 47, 48 are designed to allow their respective legs 41, 42, 43, 44 only to a restricted extent such that the legs 41, 42, 43, 44 cannot pivot beyond the unfolded position. Accordingly, an angle a defined between the legs 41, 42, 43, 44 and their respective longitudinal bars 21, 22, 23, 24 can vary between 0° (in the folded position) and $\alpha_{max}$ (in the unfolded position). The maximum angle $\alpha_{max}$ is preferably sufficiently larger than 90° but sufficiently less than 180°. In the unfolded position as shown in FIGS. 5 and 6, this configuration helps prevent the legs 41, 42, 43, 44 from accidentally pivoting to the folded position ($\alpha$=0°) because of the weight of the user (not shown). Accordingly, the legs 41, 42, 43, 44 and their respective leg hinge brackets 45, 46, 47, 48 can be maintained in the unfolded position supporting their respective longitudinal bars 21, 22, 23, 24, without needing leg locking means. In FIGS. 5 and 6 where the legs 41, 42, 43, 44 are shown in the unfolded position, the angle $\alpha$ is $\alpha_{max}$ ($\alpha=\alpha_{max}$).

Figure 8:
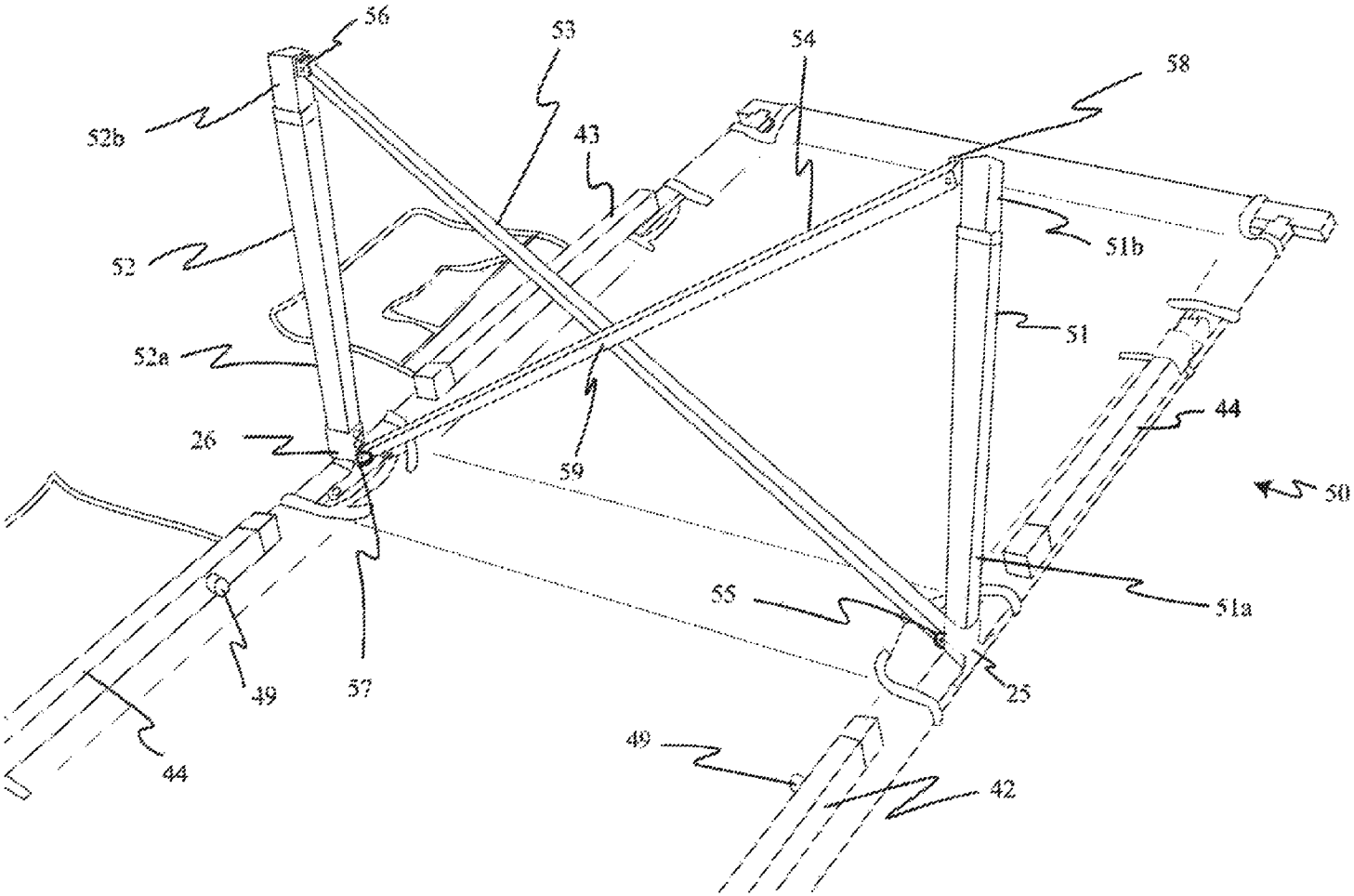
FIG. 8 is a partial, bottom perspective view of the foldable cot of FIG. 1 where the transverse bars and the leg connecting bars are removed and the legs are in the folded position.

In the unfolded position as shown in FIG. 3, the first and third legs 41, 43 are connected by a first leg connecting bar 61. The first leg connecting bar 61 is removably connected between the first and third legs 41, 43. In the unfolded position, the second and fourth legs 42, 44 are connected by a second leg connecting bar 62. The second leg connecting bar 62 is removably connected between the second and fourth legs 42, 44. In FIG. 8, the foldable cot 1 is shown with the first and second leg connecting bars 61, 62 removed. In FIG. 8, the first and second transverse bars 31, 32 are also removed and the first, second, third, and fourth legs are all in the folded position ($\alpha$=0°).

Figure 9:
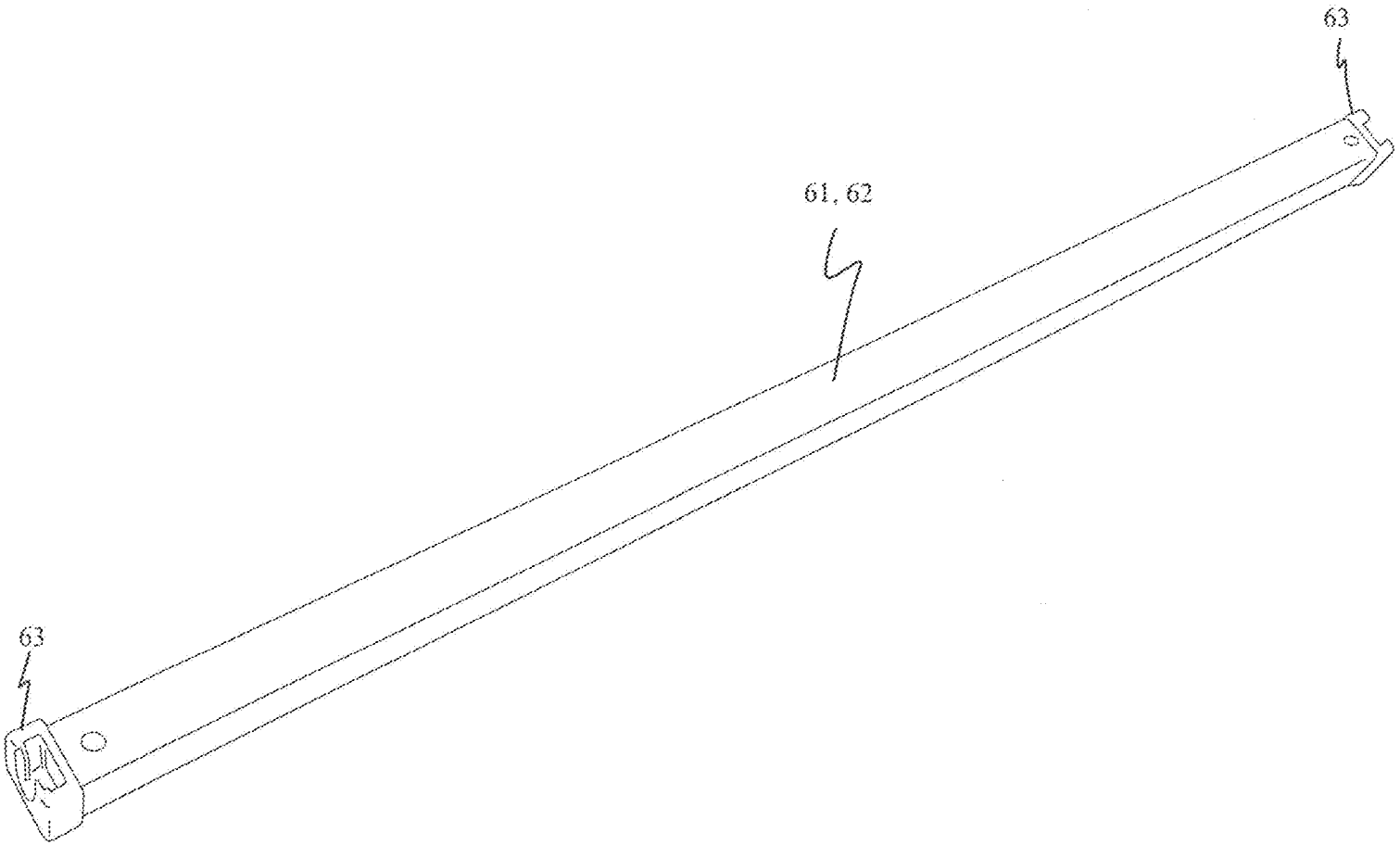
FIG. 9 is a perspective view of the leg connecting bar removed from the foldable cot of FIG. 1.

As seen in FIG. 8, the first, second, third, and fourth legs 41, 42, 43, 44 each has a male mount 49 having an enlarged head portion. As best seen in FIG. 9, the first and second leg connecting bars 61, 62 each has a pair of identical female mounts 63 at its ends for removably receiving the enlarged head portion of the male mount 49 of the legs 41, 42, 43, 44.

The foldable frame 20 also has a middle support structure 50. The middle support structure 50 allows the foldable frame 20 to be folded from an unfolded position to a folded position in its transverse direction. The middle support structure 50 has the first vertical pole 51. The first vertical pole 51 has a top end fixedly attached to the first middle hinge connector 25. The middle support structure 50 also has the second vertical pole 52. The second vertical pole 52 has a top end fixedly attached to the second middle hinge connector 26. The first and second vertical poles 51, 52 are extendible from a retracted position to an extended position. FIG. 8 shows the vertical poles 51, 52 in the retracted position. When the vertical poles 51, 52 are in the retracted position as in FIG. 8, the middle support structure 50 is in the unfolded position.

In the illustrated embodiment, the first vertical pole 51 is comprised of a hollowed member 51*a* attached to the first middle hinge connector 25 and an inner rod 51*b* slideably disposed within the hollowed member 51*a*. The second vertical pole 52 is also comprised of a hollowed member 52*a* attached to the second middle hinge connector 26 and an inner rod 52*b* slideably disposed within the hollowed member 52*a*.

The middle support structure 50 also has a first crossbar 53 and a second crossbar 54. In FIG. 8, the first and second crossbars 53, 54 form a general X-shape. An upper end of the first crossbar 53 is pivotably connected to the first middle hinge connector 25. A lower end of the first crossbar 53 is pivotably connected to the bottom end of the inner rod 52*b* of the second vertical pole 52. An upper end of the second crossbar 54 is pivotably connected to the second middle hinge connector 26. A lower end of the second crossbar 54 is pivotably connected to the bottom end of the inner rod 51*b* of the first vertical pole 51. The first and second crossbars can be pivotably connected to each other in the middle via a pivot pin 59.

In the illustrated embodiment, a first L-shaped crossbar hinge bracket 55 is attached to the first middle hinge connector 25. A second L-shaped crossbar hinge bracket 56 is attached to the bottom end of the inner rod 52*b* of the second vertical pole 52. A third L-shaped crossbar hinge bracket 57 is attached to the second middle hinge connector 26. A fourth L-shaped crossbar hinge bracket 58 is attached to the bottom end of the inner rod 51*b* of the first vertical pole 51. The upper end of the first crossbar 53 is pivotably connected to the first middle hinge connector 25 via the first L-shaped crossbar hinge bracket 55 and the lower end of the first crossbar 53 is pivotably connected to the bottom end of the inner rod 52*b* of the second vertical pole 52 via the second L-shaped crossbar hinge bracket 56. The upper end of the second crossbar 54 is pivotably connected to the second middle hinge connector 26 via the third L-shaped crossbar hinge bracket 57, and the lower end of the second crossbar 54 is pivotably connected to the bottom end of the inner rod 51*b* of the first vertical pole 51 via the fourth L-shaped crossbar hinge bracket 58.

Figure 10:
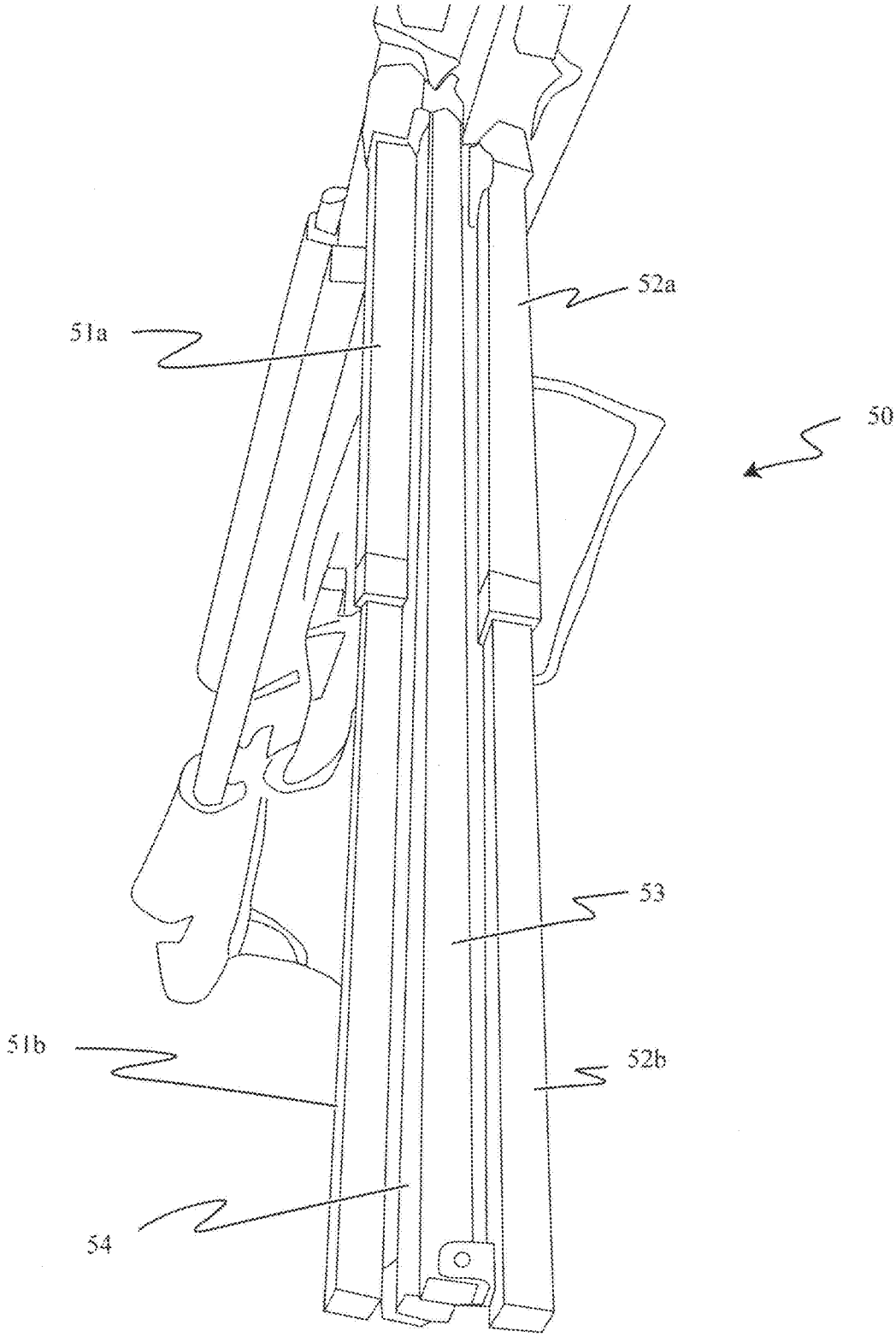
FIG. 10 is a partial, bottom perspective view of the foldable cot of FIG. 1 where the transverse bars and the leg connecting bars are removed, the legs are in the folded position, and the middle support structure is in the folded position.

While FIG. 8 shoves the middle support structure 50 in the unfolded position, FIG. 10 shows the middle support structure 50 in the folded position. When the first and second vertical poles 51, 52 are brought close to each other, the crossbars 53, 54 stand upright rotating relative to each other and the inner rods 51*b*, 52*b* are slidingly extended out of the hollowed members 51*a*, 52*a*, extending the length of the vertical poles 51, 52. In other words, the combination of the rotating motion of the crossbars 53, 54 and the extension of the inner rods 51*b*, 52*b* allows the vertical poles 51, 52 to move toward each other, collapsing the middle support structure 50.

The longitudinal bars 21, 22, 23, 24 and the transverse bars 31, 32 arc preferably made hollow to reduce the weight. The vertical poles 51, 52 and the crossbars 53, 54 are preferably made hollow to reduce the weight. The legs 41, 42, 43, 44 and the leg connecting bars 61, 62 are preferably made hollow to reduce the weight.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments but should be defined only in accordance with the following claims appended hereto and their equivalents.

What is claimed is:

1. A foldable cot comprising:

a foldable frame having a folded position and an unfolded position; and a flexible sheet having a generally rectangular shape, said flexible sheet having peripheral portions secured to said foldable frame;

said foldable frame comprising:

a first longitudinal bar and a second longitudinal bar hingedly connected with each other via a first middle hinge connector;

a third longitudinal bar and a fourth longitudinal bar hingedly connected with each other via a second middle hinge connector;

a middle support structure mounted to said first and second middle hinge connectors;

a first leg pivotably attached to said first longitudinal bar;

a second leg pivotably attached to said second longitudinal bar;

a third leg pivotably attached to said third longitudinal bar; and a fourth leg pivotably attached to said fourth longitudinal bar wherein said middle support structure comprises a first crossbar and a second crossbar together forming a general X-shape when said foldable frame is in said unfolded position, and wherein an upper end of said first and second crossbars are pivotably connected to said first and second middle hinge connectors, respectively;

wherein said middle support structure further comprises a first vertical pole and a second vertical pole each having a top end attached to said first and second middle hinge connectors, respectively, and wherein a lower end of said first and second crossbars are pivotably connected to a bottom end of said first and second vertical poles, respectively;

wherein said first and second vertical poles are extendible between a retracted position and an extended position, wherein said first and second vertical poles are in said retracted position when said foldable frame is in said unfolded position, and wherein said first and second vertical poles are in said extended position when said foldable frame is in said folded position;

wherein said first, second, third, and fourth legs are pivotably connected to said first, second, third, and fourth longitudinal bars, respectively, via leg hinge brackets such that said leg hinge brackets allow said legs to pivot between a folded position and an unfolded position, said unfolded position and folded position defining therebetween an angle substantially larger than 90° but substantially less than 180°; and wherein said first, second, third, and fourth legs are pivotable relative to their respective longitudinal bars independently of one another.

2. The foldable cot of claim 1, wherein said first and second crossbars are connected in the middle to each other such that said first and second crossbars are rotatable relative to each other.

3. The foldable cot of claim 1, wherein said first and second vertical poles each comprises a first pole member and a second pole member, said first pole member of said first and second vertical poles attached to said first and second middle hinge connectors, respectively, said second pole member slidable along said first pole member.

4. The foldable cot of claim 3, wherein said first pole member comprises a hollowed member, and said second pole member comprises an inner rod slideably disposed within said hollowed member; and wherein said first and second vertical poles are in said extended position when said inner rods are extended out of said hollowed members, and wherein said first and second vertical poles are in said retracted position when said inner rods are retracted into said hollowed member.

5. The foldable cot of claim 4, wherein said hollowed members and inner rods have angled cross-section such that said inner rods are not allowed to rotate within said hollowed members relative to said hollowed members.

6. The foldable cot of claim 1, wherein said first and second crossbars are pivotably connected to said first and second middle hinge connectors and to said bottom end of said first and second vertical poles via L-shaped crossbar hinge brackets.

7. The foldable cot of claim 1, wherein said foldable frame further comprises:

a first transverse bar removably connected between said first and third longitudinal bars; and a second transverse bar removably connected between said second and fourth longitudinal bars.

8. The foldable cot of claim 7, wherein said first and second transverse bars are identical, and wherein said first, second, third, and fourth longitudinal bars each has a mount for removably attaching said first and second transverse bars thereto.

9. The foldable cot of claim 7, wherein said flexible sheet has a plurality of longitudinal sleeves in said peripheral portions for receiving said first, second, third, and fourth longitudinal bars therein, and wherein said flexible sheet has a plurality of transverse sleeves in said peripheral portions for removably receiving said first and second transverse bars therein.

10. The foldable cot of claim 9, wherein said foldable frame further comprises:

a first leg connecting bar removably connected between said first and third legs; and a second leg connecting bar removably connected between said second and fourth legs.

11. The foldable cot of claim 10, wherein said first and second leg connecting bars are identical, and wherein said first, second, third, and fourth legs each has a mount for removably attaching said first and second leg connecting bars thereto.

12. The foldable cot of claim 1, wherein said flexible sheet has a plurality of longitudinal sleeves in said peripheral portions for receiving said first, second, third, and fourth longitudinal bars therein.

13. A foldable cot frame having a folded position and an unfolded position, comprising:

a first longitudinal bar and a second longitudinal bar hingedly connected with each other via a first middle hinge connector;

a third longitudinal bar and a fourth longitudinal bar hingedly connected with each other via a second middle hinge connector;

a middle support structure mounted to said first and second middle hinge connectors;

a first leg pivotably attached to said first longitudinal bar;

a second leg pivotably attached to said second longitudinal bar;

a third leg pivotably attached to said third longitudinal bar; and a fourth leg pivotably attached to said fourth longitudinal bar wherein said middle support structure comprises a first crossbar and a second crossbar together forming a general X-shape when said foldable frame is in said unfolded position, and wherein an upper end of said first and second crossbars are pivotably connected to said first and second middle hinge connectors, respectively;

wherein said middle support structure further comprises a first vertical pole and a second vertical pole each having a top end attached to said first and second middle hinge connectors, respectively, and wherein a lower end of said first and second crossbars are pivotably connected to a bottom end of said first and second vertical poles, respectively; and wherein said first and second vertical poles are extendible between a retracted position and an extended position, wherein said first and second vertical poles are in said retracted position when said foldable frame is in said unfolded position, and wherein said first and second vertical poles are in said extended position when said foldable frame is in said folded position;

wherein said first, second, third, and fourth legs are pivotably connected to said first, second, third, and fourth longitudinal bars, respectively, via leg hinge brackets such that said leg hinge brackets allow said legs to pivot between a folded position and an unfolded position, said unfolded position and folded position defining therebetween an angle substantially larger than 90° but substantially less than 180°; and wherein said first, second, third, and fourth legs are pivotable relative to their respective longitudinal bars independently of one another.

14. The foldable cot of claim 13, wherein said first and second vertical poles each comprises a first pole member and a second pole member, said first pole member of said first and second vertical poles attached to said first and second middle hinge connectors, respectively, said second pole member slidable along said first pole member.

15. The foldable cot of claim 14, wherein said first pole member comprises a hollowed member, and said second pole member comprises an inner rod slideably disposed within said hollowed member; and wherein said first and second vertical poles are in said extended position when said inner rods are extended out of said hollowed members, and wherein said first and second vertical poles are in said retracted position when said inner rods are retracted into said hollowed member.

16. The foldable cot frame of claim 13, further comprising:

a first transverse bar removably connected between said first and third longitudinal bars; and a second transverse bar removably connected between said second and fourth longitudinal bars.

* * * * *